United States Patent [19]

Jones et al.

[11] 4,279,622

[45] Jul. 21, 1981

[54] GAS-GAS QUENCH COOLING AND SOLIDS SEPARATION PROCESS

[75] Inventors: Henry B. Jones; Randlow Smith, both of Houston, Tex.

[73] Assignee: Texaco Inc., White Plains, N.Y.

[21] Appl. No.: 102,715

[22] Filed: Dec. 12, 1979

Related U.S. Application Data

[62] Division of Ser. No. 57,228, Jul. 13, 1979.

[51] Int. Cl.[3] ..... C10J 3/46

[52] U.S. Cl. ..... 48/197 R; 48/206; 55/23; 55/83; 252/373

[58] Field of Search ..... 55/126, 267, 315, 318, 55/337, 340, 344, 349, 23, 80, 83, 97; 48/128, 206, 197 R, 62 R, 202, 210; 422/207; 252/373

[56] References Cited

U.S. PATENT DOCUMENTS

| | | | |
|---|---|---|---|
| 3,963,457 | 6/1976 | Hess | 48/202 |
| 4,054,424 | 10/1977 | Staudinger et al. | 55/83 |
| 4,157,244 | 6/1979 | Gerhardt et al. | 55/83 |

FOREIGN PATENT DOCUMENTS

| | | | |
|---|---|---|---|
| 847047 | 8/1952 | Fed. Rep. of Germany | 48/202 |

*Primary Examiner*—Peter F. Kratz

*Attorney, Agent, or Firm*—Carl G. Ries; Robert A. Kulason; Albert Brent

[57] ABSTRACT

A hot raw gas stream, as produced by the partial oxidation of a solid carbonaceous fuel such as coal, is partially cooled and cleaned to remove entrained solid matter and slag. A novel gas-gas quench cooling and solids separation apparatus is employed. The apparatus comprises a closed cylindrical insulated vertical pressure vessel containing a lower quench chamber in communication with an upper solids separation chamber. The hot raw gas stream is cooled in the lower chamber to a temperature below the initial deformation temperature of the entrained slag by impingement and direct heat exchange with an oppositely directed coaxial stream of cooled, cleaned, and compressed recycle quench gas. The stream of cooled gas leaving the turbulent lower chamber passes up through a choke-ring into the comparatively calmer upper chamber counter-currently with solid slag droplets which separate out by gravity. Residual solid particles are removed from the gas stream by at least one cyclone separator located in the upper chamber. A portion of the cooled and cleaned gas stream leaving the vessel, with further cooling and with or without further cleaning downstream is recycled back to the vessel for use as said quench gas. Slag particles and other solid matter that are separated within the pressure vessel are removed at the bottom of the lower chamber.

15 Claims, 1 Drawing Figure

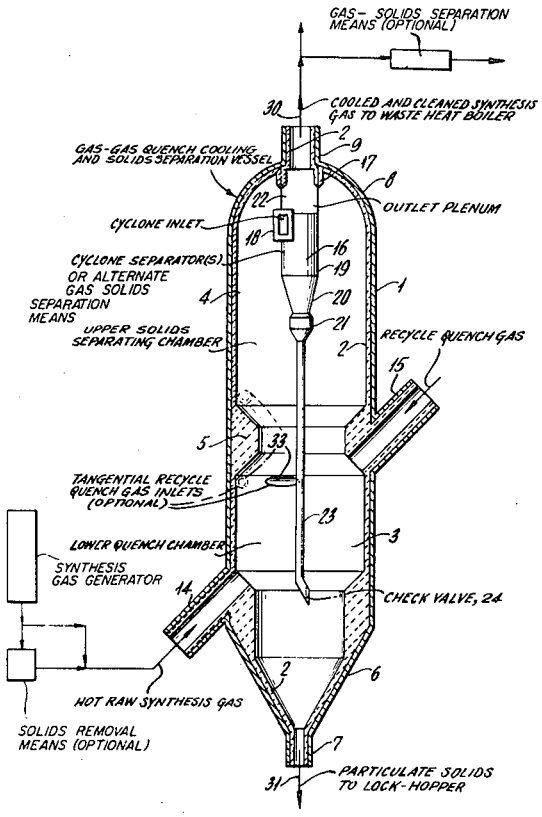

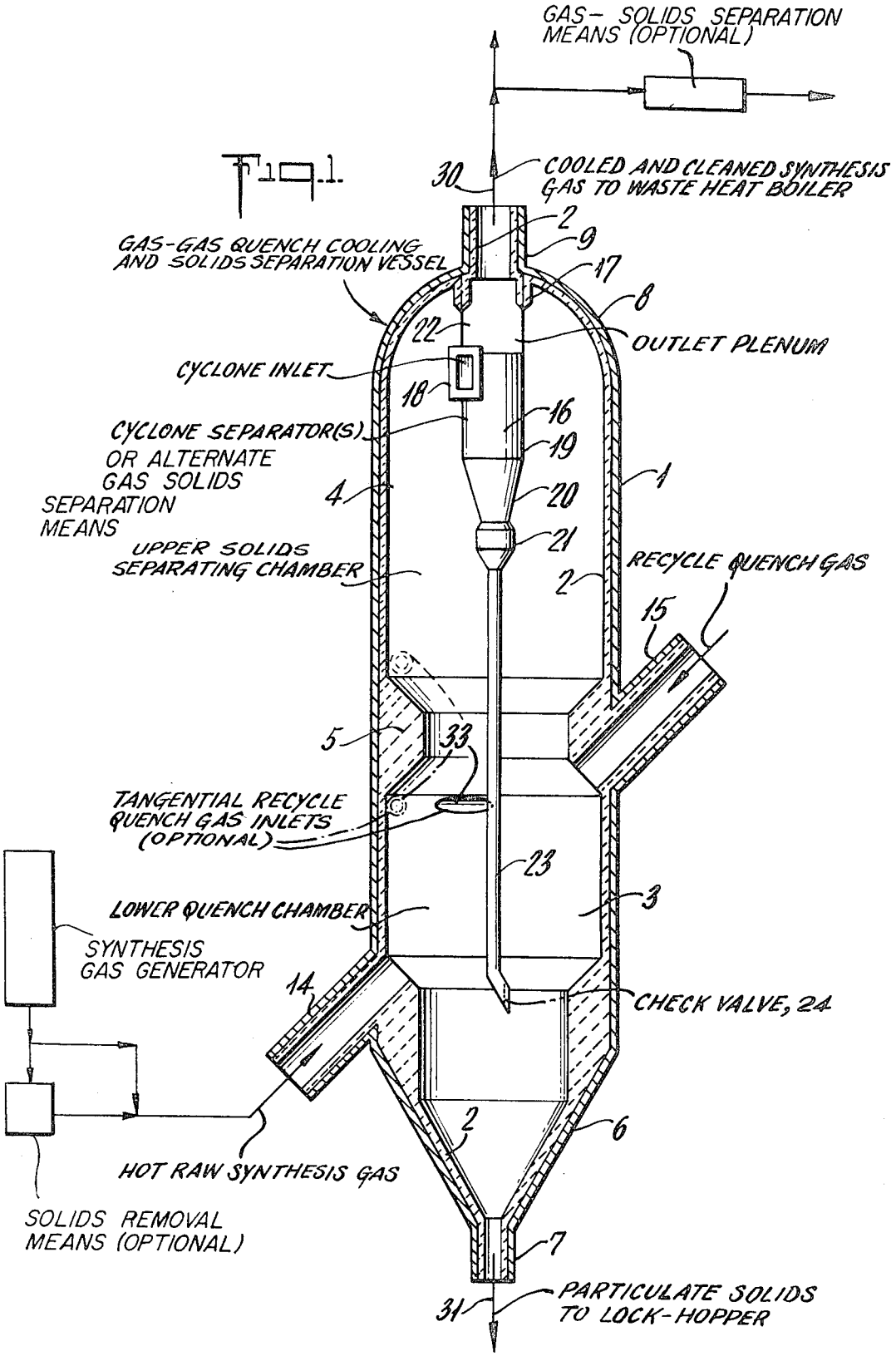
Fig. 1.
GAS- SOLIDS SEPARATION MEANS (OPTIONAL)
30
COOLED AND CLEANED SYNTHESIS GAS TO WASTE HEAT BOILER
2
9
17
8
GAS-GAS QUENCH COOLING AND SOLIDS SEPARATION VESSEL
22
OUTLET PLENUM
CYCLONE INLET
18
16
CYCLONE SEPARATOR(S) OR ALTERNATE GAS SOLIDS SEPARATION MEANS
19
4
20
1
21
UPPER SOLIDS SEPARATING CHAMBER
2
RECYCLE QUENCH GAS
15
5
33
TANGENTIAL RECYCLE QUENCH GAS INLETS (OPTIONAL)
23
LOWER QUENCH CHAMBER
3
SYNTHESIS GAS GENERATOR
14
CHECK VALVE, 24
2
6
HOT RAW SYNTHESIS GAS
SOLIDS REMOVAL MEANS (OPTIONAL)
7
31
PARTICULATE SOLIDS TO LOCK-HOPPER

GAS-GAS QUENCH COOLING AND SOLIDS SEPARATION PROCESS

This is a division of application Ser. No. 057,228, filed July 13, 1979.

BACKGROUND OF THE INVENTION

1. Field of the Invention

This invention relates to the manufacture of clean gaseous mixtures comprising $H_2$ and CO. More particularly, it pertains to the apparatus and related process for cooling and cleaning the hot raw gas stream produced by the partial oxidation of solid carbonaceous fuels and principally comprising $H_2$, CO, $CO_2$, $H_2O$ and containing entrained solid matter and slag.

2. Description of the Prior Art

In the partial oxidation of liquid and solid hydrocarbonaceous fuels with steam and free oxygen to produce gaseous mixtures comprising carbon monoxide and hydrogen, the gases leave the gas generator at a temperature in the range of about 1700° to 3000° F. Depending on the feed and operating conditions, entrained in the gas stream leaving the gas generator are various amounts of molten slag and solid matter such as soot and ash. It is often desirable to reduce the concentration of these entrained materials. For example, by removing solids from the gas stream, one may increase the life of downstream apparatus that is contacted by the gas stream, such as the life of gas coolers and turbines. Solids removal from the synthesis gas will also prevent plugging of catalyst beds. Further, environmentally acceptable gas may be produced.

In coassigned U.S. Pat. No. 2,871,114-Du Bois Eastman, the product gas and slag from the gasification of coal are passed into a slag pot placed directly below the generator. Water is supplied to the slag pot to collect and solidify the slag which drops out of the gas stream. The gas stream leaves the slag pot and is passed into a quench accumulator vessel where the gas is intimately contacted with water and cooled to a temperature in the range of about 300°-600° F. The gas stream leaving the quench tank is saturated with $H_2O$. When the raw gas stream leaving a coal fired generator at a temperature above about 1700° F. is introduced directly into a gas cooler, the slag entrained in the gas stream will deposit out on the inside surfaces of the gas cooler and foul the heat exchange surfaces. In U.S. Pat. No. 4,054,424 no means is provided for removal of the slag from the system.

In contrast with the prior art, by the subject invention, the raw synthesis gas is cleaned without quenching in water and is therefore not saturated. It is also cooled to a temperature in the range of about 1200° to 1800° F., and below the initial deformation temperature of the slag. The thermal energy in the gas stream may be recovered at a high temperature level. Further, the solidified slag particles are removed from the system. Fouling of equipment located downstream for recovering energy from the hot gas stream is thereby avoided.

SUMMARY

This invention pertains to a process for producing hot raw gas stream principally comprising $H_2$, CO, $CO_2$, $H_2O$, and containing entrained solid matter and molten slag, by the partial oxidation of a solid carbonaceous fuel such as coal and cooling and cleaning the raw gas stream to remove the entrained solid matter and slag. A novel gas-gas quench cooling and solids separation apparatus is employed. The apparatus comprises a closed cylindrical insulated vertical pressure vessel containing a lower quench chamber in communication with an upper solids separation chamber. The hot raw gas stream is introduced into the lower chamber where the gas temperature is reduced to a temperature in the range of about 1200° to 1800° F. and below the initial deformation temperature of the slag by impingement and direct heat exchange with an oppositely directed coaxial stream of cooled cleaned and compressed recycle quench gas. Solid particles are separated from the raw gas stream and are discharged through an outlet at the bottom of the lower chamber. A choke-ring passage separates the lower chamber from the upper chamber. The stream of cooled gas leaving the turbulent lower chamber passes up through the choke-ring counter-currently with solid slag droplets which separate out from above by gravity. Optionally, a solids separation means from the group single-stage and multi-stage cyclones, impingement separator, filter, and combinations thereof may be located in the upper chamber to remove residual carbon containing fines and solid slag droplets that remain in the cooled gas stream. In a preferable embodiment, a solids separation means from the group single-stage cyclone, multi-stage cyclones, and combinations thereof are mounted in said upper chamber. A cooled and cleaned gas stream is discharged from the upper chamber, and subjected to further cooling, and if necessary additional cleaning. A portion of this gas stream is then compressed and returned to the lower chamber as said cooled and cleaned recycle quench gas stream.

BRIEF DESCRIPTION OF THE DRAWING

The invention will be further understood by reference to the accompanying drawing in which:

FIG. 1 is a diagrammatic representation of the gas-gas quench cooling and solids separation apparatus in vertical cross section.

DESCRIPTION OF THE INVENTION

The present invention pertains to an improved continuous process and related apparatus for cooling and cleaning a hot raw gas stream principally comprising $H_2$, CO, $CO_2$, and $H_2O$ and containing entrained solid matter and molten slag. The apparatus is particularly useful for cooling and cleaning the hot raw stream of gas that is produced by the partial oxidation of a solid carbonaceous fuel. The fuel is introduced into the gas generator either alone or in the presence of substantially thermally liquefiable or vaporizable hydrocarbon or carbonaceous materials and/or water, or entrained in a gaseous medium from the group stream, $CO_2$, $N_2$, synthesis gas, and mixtures thereof. Vaporizable hydrocarbons include by definition petroleum distillates and residue, oil derived from coal, shale oil, crude petroleum, gas oil, tar sand oil, cycle gas oil from fluid-catalytic cracking operation, furfural extract of coker gas oil, and mixtures thereof. Solid carbonaceous fuel includes by definition particulate carbon, coal, coke from coal, lignite, petroleum coke, oil shale, tar sands, asphalt, pitch and mixtures thereof. By means of the subject invention the combustion residues entrained in the raw gas stream from the gas generator may be reduced to an acceptable level of concentration and particle size for downstream heat exchange equipment.

Because of the dwindling world-wide oil and natural gas reserves, there is a growing emphasis on finding new sources of energy. Coal is the most promising replacement material. One ton of coal contains the same amount of energy as three to four barrels of crude oil. Fortunately, one third of the world's economically recoverable coal reserves are located in the United States; and there is enough coal in the United States to last more than 200 years. By means of the subject invention solid carbonaceous fuel may be converted into an environmentally acceptable fuel gas or reducing gas, or into a clean synthesis gas for the manufacture of chemicals. Atmospheric pollution, due to particulate exhausts, may be controlled.

The recovery of energy from the hot raw gas stream from the partial oxidation gas generator will increase the thermal efficiency of the gasification process. Thus, by-product steam for use in the process or for export may be produced by heat exchange of the hot gas stream with water in a gas cooler. Energy recovery, however, is made difficult by the presence in the generator exhaust gases of droplets of molten slag resulting from the fusion of the ash content of the coal fed to the generator. The instant invention is a means and method for solidifying the molten slag droplets and removing the resulting particulates from the gases thereby simplifying energy recovery. Common problems with build-up of slag are avoided in the subject invention by solidifying the slag particles before they impinge on solid surfaces. Further, solid surfaces are removed from the point of inception of slag cooling.

Depending on the amount of unconverted solids and ash in the raw gas stream leaving the gas generator, the subject means and method may stand alone or may follow a preliminary separation of solids and liquid slag from the gases. While the subject invention may be used to process the hot raw effluent gas stream from almost any type of gas generator, it is particularly suitable for use down stream of a partial oxidation gas generator. An example of such a gas generator is shown and described in coassigned U.S. Pat. No. 2,829,957, which is incorporated herewith by reference. In one embodiment, our novel gas-gas quench cooling and solids separation apparatus may be connected before a gas cooler in a system which includes a gas generator for producing synthesis gas and a gas cooler. For example, a partial oxidation gas generator and a waste heat boiler may be interconnected by a plenum, with or without a separable catch pot as shown in coassigned U.S. Pat. No. 3,565,588, which is incorporated herewith by reference. In such case, the subject apparatus may be connected in the line immediately upstream of a gas cooler or waste heat boiler in which boiler feed water is converted into steam. By the subject invention, combustion residue in the gas stream is removed, fouling of boiler tubes is prevented, and the life of convection-type heat exchangers is increased.

The subject apparatus comprises a closed cylindrical vertical pressure vessel whose inside walls are thermally insulated. For example, the vessel may be internally lined with high temperature resistant refractory. Within the vessel are two cylindrical vertical refractory lined chambers that are coaxial with the central axis of the vessel and which are in communication with each other. These chambers are a lower quench chamber and an upper solids separation chamber. A coaxial choke-ring passage connects the two chambers. The longitudinal axis of at least one pair of opposed coaxial internally insulated inlet nozzles passes through the walls of the lower chamber. The inlet nozzles are spaced 180° apart and are located on opposite sides of the lower chamber. The hot raw gas stream is passed through one inlet nozzle and a comparatively cooler and cleaner recycle stream of quench gas is passed through the opposite inlet nozzle. The two streams impinge each other within the lower chamber and the head-on collision produces a turbulent mixture of gases. The high turbulence results in rapid mixing of the opposed gas streams and direct heat exchange.

While the following discussion pertains to a single pair of inlet nozzles, which is the usual design, a plurality of pairs of inlet nozzles, say 2 to 10, of similar description, may be employed. The pairs of nozzles may be evenly spaced around the vessel. The longitudinal axis of the inlet nozzles may be inclined to direct raw gas flow upward as shown in the drawing, or enter horizontally. Alternatively, the longitudinal axis may be inclined to direct raw gas flow downward if better suited to the overall configuration of the gas generator and the subject quench-separator apparatus. Thus, the longitudinal axis common to each pair of inlet nozzles is in the same plane with the central vertical axis of the vessel and may be at any angle in the range of about 30° to 150° with and measured clockwise from the central vertical axis of the vessel. Suitably, this angle may be in the range of about 40° to 135°, say about 45° as shown in the drawing. The actual angle is a function of such factors as temperature and velocity of the gas streams, and the composition, concentration and characteristics of the entrained matter to be removed. For example, when the raw gas stream contains liquid slag of high fluidity, the longitudinal axis of the raw gas inlet nozzle may be pointed upward at an angle of about 45° measured clockwise from the central vertical axis of the vessel. Much of the slag would then run down the transfer line and be collected in a slag pot upstream of the subject apparatus. On the other hand when the liquid slag is viscous, the flow of the slag may be helped by pointing the raw gas inlet nozzle downward, say at of about 135° measured clockwise from the central vertical axis of the vessel. The high velocity of the hot raw gas stream through the inlet nozzle and the force of the gravity would then help to move the viscous liquid slag into the lower chamber, where it solidifies and is separated from the gas stream by gravity.

The hot raw gas stream enters through one inlet nozzle at a temperature in the range of about 1700° F. to 3100° F. such as 2000° to 3000° F., say about 2300° to 2800° F., for example 2500° F. The pressure is in the range of about 10 to 200 atmospheres, say about 25 to 85 atmospheres and typically about 40 atmospheres. The velocity is in the range of about 10 to 100 feet per second say about 20 to 50 feet per second, and typically about 30 feet per second. The concentration of the solids in the entering hot raw gas stream may be in the range of about 0.1 to 4.0 grams per standard cubic foot (SCF), say about 0.25 to 2.0 grams per SCF. The particle size may be in the range of about 40 to 1000 micrometers or roughly equivalent to Stairmand's coarse dust—Filtration and Separation Vol. 7, No. 1 page 53, 1970 Uplands Press Ltd., Croydon, England.

The cooled cleaned recycle stream of quench gas which enters through the opposite inlet nozzle is obtained from at least a portion i.e. about 20 to 80 mol %. say about 30 to 65 mol %, and typically about 60 mol % of the overhead stream from the subject apparatus, with or without further cleaning and/or cooling. The temperature of the quench gas is in the range of about 200° to 800° F., say about 300° to 600° F., and typically about 350° F. The mass flow rate and/or the velocity of the hot raw gas stream and the cooled cleaned recycled stream of quench gas are adjusted so that the momentum of the two opposed inlet gas streams is about the same.

In Table I below, there are shown in columns 3 and 4 temperature and composition of typical gas mixtures that are produced when streams of raw synthesis gas and cooled cleaned recycle quench gas, at the temperatures shown in columns 1 and 2, collide in the lower quench chamber.

TABLE I

| Synthesis Raw Gas °F. | Recycle Quench Gas °F. | Gas Mixture Leaving Lower Quench Chamber | |
|---|---|---|---|
| | | Temperature °F. | Amount of Recycle Quench Gas in Mixture-Mol % |
| 3100 | 800 | 1200 | 85 |
| 1700 | 300 | 1300 | 30 |
| 2800 | 600 | 1500 | 62 |
| 2500 | 400 | 1700 | 41 |
| 2650 | 500 | 1600 | 52 |
| 2650 | 500 | 1800 | 43 |
| 2650 | 500 | 1400 | 61 |

The ends of each pair of opposed inlet nozzles preferably do not extend significantly into the chamber. Preferably, the opposed inlet nozzles terminate in planes normal to their centerline. By this means, deviation of these streams from concentricity is minimized. The jets of gas which leave from the opposed nozzles travel about 5 to 10 feet, say about 8 feet, before they directly impinge with each other. The high turbulence that results in the lower chamber promotes rapid mixing of the gas streams. This promotes gas to particle heat transfer. Thus through turbulent mixing of the cooled and cooling streams of gas, solidification of the outer layer of the slag particles takes place before the slag can impinge on solid surfaces. A gas mixture is produced having a temperature below the initial deformation temperature of the slag entering with the raw gas stream i.e. about 1200° to 1800° F. typically about 1400° F. The entrained slag is cooled and a solidified shell is formed on the slag particles which prevent them from sticking to the inside walls of the apparatus, or to any solid structural member contained therein. In one embodiment, from about 1 to 50 volume % of the recycle quench gas stream is introduced into the subject quench-separation apparatus by way of a plurality of tangential nozzles located at the top of the lower chamber and/or the bottom of the upper chamber. By this means, a swirl is imparted to the upward flowing gases. Additionally, this will provide a protective belt of cooler gas along the inside wall of the choke ring and above.

Solid matter i.e. unconverted coal, carbon particles, carbon containing particulate solids, slag particles, ash, and bits of refractory, separate from the raw gas stream and fall to the bottom of the lower chamber where they are removed through an outlet at the bottom of the pressure vessel. A lock-hopper system for maintaining the pressure in the vessel is connected to the bottom outlet. Preferably, the bottom of the pressure vessel has a low point that is connected to the bottom outlet. For example, the bottom of the pressure vessel may be a truncated cone, or spherically, or elliptically shaped.

The choke ring provides a corridor joining the lower and upper chambers. It is used to dampen out the turbulence of the gas stream from the lower chamber. By this means the upward flow of the gas stream is made orderly. In comparison with the turbulence in the bottom chamber, the gas rising through the upper chamber is relatively calm. This promotes gravity settling of solid particles which fall down through the choke ring and into the bottom of the lower chamber. The choke ring is preferably made from a thermally resistant refractory. Its diameter is smaller than either the diameter of the upper or the lower chamber. The diameters of the upper and lower chambers depend on such factors as the velocity of the gas stream flowing therein and the size of the entrained particles. The ratio of the diameter of the upper chamber ($d_u$) to the diameter of the lower chamber ($d_l$) is in the range of about 1.0 to 1.5, and typically about 1.0. The ratio of the diameter of the choke ring ($d_c$) to diameter of the lower chamber ($d_l$) is in the range of about 0.5 to 0.9, such as about 0.6 to 0.8, say 0.75.

While the upper chamber may be vacant to provide additional space for gravity settling of entrained solids, preferably, mounted within the upper chamber are at least 1, such as 2–12, say 2 gas-solids separation means for removing at least a portion of the solid particles remaining in the gas stream. Typical gas-solids means that may be used in the upper chamber may be selected from the group: single-stage cyclone separator, multi-stage cyclone separator, impingement separator, filter, and combinations thereof. In a preferable embodiment, single-stage or multi-stage cyclone separators, or combinations thereof are employed in the upper chamber as said gas-solid separation means. The actual number of gas-solids separation means employed will depend on such factors as the dimensions of the upper chamber and the actual volumetric rate of the gas stream approaching the entrance to the gas-solids separation means at the top of the upper chamber. At this point, the concentration of solids is in the range of about 0.05 to 2 grams per SCF. The particle size is in the range of about 40 to 200 micrometers or approximately equivalent to Stairmand's fine dust. Any conventional continuous gas-solids separation means may be employed that will remove over about 65 wt. % of the solid particles in the gas stream and which will withstand the operating conditions in the upper chamber. The pressure drop through the gas-solid separation means is preferably less than 20 inlet velocity heads. Further, the separation means should withstand hot abrasive gas streams at a temperature up to about 2000° F.

Preferred gas-solids separators are of the cyclone-type. A cyclone is essentially a settling chamber in which the force of gravity is replaced by centrifugal acceleration. In the dry-type cyclone separator, the stream of raw gas laden with particulate solids enters a cylindrical conical chamber tangentially at one or more entrances at the upper end. The gas path involves a double vortex with the raw gas stream spiraling downward at the outside and the clean gas stream spiraling upward on the inside to a central, or concentric gas outlet tube at the top. The clean gas stream leaves the cyclone and then passes out of the vessel through an outlet at the top. The solid particles, by virtue of their inertia, will tend to move in the cyclone toward the separator wall from which they are led into a discharge pipe by way of a central outlet at the bottom. Small sized particles will form clusters that may be easily removed by the cyclone.

For example, at least one single stage cyclone may be mounted within the upper chamber with its inlet facing the horizontal circular component of a rising spiral flow pattern, which will be existent in the embodiment wherein a portion of the quench gas enters the vessel tangentially or will otherwise be induced by the cyclone inlet flow. With a plurality of single-stage cyclones connected in parallel, the gas outlet tube for each cyclone may discharge into a common internal plenum chamber that is supported within the upper chamber. The cleaned gas stream exits from the plenum chamber through the gas outlet at the top of the upper chamber. In another embodiment, at least one multiple-stage cyclone unit is supported within the upper chamber. In such case, the partially cleaned gas stream that is discharged from a first-stage internal cyclone is passed into a second-stage cyclone that is supported within the upper chamber. The clean gas stream from each second-stage cyclone is discharged into a common internal plenum chamber that is supported at the top of the upper chamber. From there, the clean gas is discharged through an outlet at the top of the upper chamber. In still other embodiments, one and two stage cyclones are arranged external to the upper chamber, with or without the inclusion of cyclones inside the upper chamber. For a more detailed discussion of cyclone and impingement separators, reference is made to CHEMICAL ENGINEER'S HANDBOOK—Perry and Chilton, Fifth Edition 1973 McGraw-Hill Book Co. Pages 20–80 to 20–87 which is incorporated herewith by reference.

A discharge pipe or dip leg extends downward within the pressure vessel from the bottom of the cyclone to preferably below the axes of the inlet nozzles in the bottom chamber, and below the highly turbulent area. Particulate solids that are separated in the cyclone may be thereby passed through the dip leg and discharged through a check valve in the dip leg into the bottom of the lower chamber below the zone of vigorous mixing. The dip leg may be removed from the path of the slag droplets by one or more of the following ways: keeping the dig leg close to the walls of the vessel, straddling the axis of the hot gas and quench gas inlet nozzles, or by putting ceramic dip legs in the refractory wall. Alternaltely, the dip legs may be shortened to terminate any place above the top of the lower chamber.

The upward superficial velocity of the gas stream in the upper chamber and the diameter and height of the upper chamber, preferably shall be such that the inlet to the cyclone separator (or separators) is above the choke ring by a distance at least equal to the Transport Disengaging Height (TDH), also referred to as the equilibrium disengaging height. Above the TDH, the rate of decrease in entrainment of the solid particles in the gas stream approaches zero. Particle entrainment varies with such factors as viscosity, density and velocity of the gas stream; specific gravity and size distribution of the solid particles; and height above the choke ring. The velocity of the gas stream through the choke ring may vary in the range of about 2 to 5 ft. per sec. The velocity of the gas stream through the upper chamber basis net cross section may vary in the range of about 1 to 3 ft. per sec. The Transport Disengaging Height may vary in the range of about 10 to 25 feet. Thus for example, if the velocity of the gas stream is about 3.5 ft./sec through the choke ring and about 2 ft./sec basis total cross section of the upper chamber or 2.5 ft./sec. basis net cross section of the upper chamber, then, the Transport Disengaging Height may be about 15 to 20 feet in an upper chamber having an inside diameter of about 10 to 15 feet.

The gas stream leaving from the plenum chamber at the top of the cyclone separators passes through an outlet in the upper portion of the upper chamber at a temperature in the range of about 1200° to 1800° F. The pressure drop of the stream of synthesis gas passing through the subject gas-solids separation system is less than about 5 psi. The concentration of solids in the exit gas stream from the separation vessel is in the range of about 30 to 700 Mgm per SCF. A portion of this gas stream is subjected to additional cooling and with or without further cleaning downstream by conventional means in order to produce the previously discussed recycle stream of quench gas. For example, a conventional gas-solids separation means may be inserted in the line downstream from the gas-gas quench cooling and solids separation apparatus. This gas-solids separation means may be selected from the group single and multi-stage cyclones, impingement separator, filter, electrostatic separator, and combinations thereof.

Advantageously, by the subject apparatus from about 85 to 95 wt. % of the entrained solid matter and slag may be removed from the hot raw gas stream leaving the partial oxidation gas generator while reducing the temperature of the gas stream to a temperature that the downstream apparatus for recovering energy from the hot gas stream will tolerate. Preferably, no liquid scrubbing fluid is employed. By this means the sensible heat in the hot gas stream is not wasted by vaporizing scrubbing fluid, which may then contaminate the gas stream. Rather, the sensible heat remaining in the cleaned gas stream leaving the subject apparatus and with or without additional cooling, cleaning or both downstream may be recovered in a convection type waste heat boiler located downstream. Thus, $H_2O$ or boiler feed water may be thereby converted into steam by indirect heat exchange. The steam may be used elsewhere in the process i.e., for heating purposes, for producing power, or in the gas generator. Alternatively, or additionally, energy recovery may be effected by other means. For example, a portion of the cooled and cleaned gas stream is passed through an expansion turbine for the production of mechanical energy, electrical energy, or both.

DESCRIPTION OF THE DRAWING

A more complete understanding of the invention may be had by reference to the accompanying drawing which illustrates in FIG. 1, one embodiment of the invention.

In FIG. 1, closed cylindrical vertical steel pressure vessel 1 is lined on the inside throughout with refractory 2 and includes coaxial lower quench chamber 3, coaxial upper solids separating chamber 4, and coaxial refractory choke ring 5. Choke ring 5 forms a cylindrically shaped passage of reduced diameter between lower chamber 3 and upper chamber 4. Vessel 1 has a conical shaped bottom 6 that converges into refractory lined bottom outlet 7. Outlet 7 is coaxial with the vertical central axis of vessel 1. Hemispherical dome 8 at the top of vessel 1 is equipped with refractory lined top outlet 9. Outlet 9 is coaxial with the vertical central axis of vessel 1.

A pair of refractory lined opposed coaxial inlet nozzles 14 and 15 extend through the vessel wall and are directed into lower chamber 3. The axis of inlet nozzles 14 and 15 makes an angle of about 45° measured clockwise from the vertical central axis of vessel 1 and lies in the same plane. Inlet nozzle 14, for introducing a hot raw gas stream, is pointed upward. Inlet nozzle 15, for introducing a stream of clean and comparatively cooler recycle quench gas, is pointed downward. While only one pair of inlet nozzles is shown in the drawing, additional pairs may be included in the apparatus.

At least one cyclone 16, with its vertical axis parallel or caoxial with the central vertical axis of vessel 1, is supported within upper chamber 4 by means of support 17. Each cyclone is resistant to heat and abrasion and has a gas inlet 18 near the upper portion of the upper chamber. When multiple cyclons are employed, they may be uniformly spaced within the chamber. The face of rectangular inlet 18 of cyclone 16 is preferably parallel to the vertical axis of vessel 1. Preferably, inlet 18 is oriented to face the direction of the incoming gas stream.

Cyclone 16 has a cylindrical body 19, a converging conical shaped bottom portion 20, solids discharge chamber 21, outlet plenum 22 which connects into upper outlet 9, dip leg 23, and check valve 24 at the bottom end of dip leg 23. Dip leg 23 may be off-set to pass close to the walls of vessel 1 and thereby avoid intersecting the common longitudinal axis of inlets 14 and 15. By this means uncooled slag particles will not contact and build-up on the dip leg. Cooled clean synthesis gas is discharged through top outlet 9 and passes through line 30 into waste heat boiler(s) and/or other means of energy recovery not shown. Particulate solids are discharged through bottom outlet 7 and pass through line 31 into a lock-hopper, not shown.

From about 1 to 4 tangential quench gas inlets 33 are optionally evenly spaced around the circumference of vessel 1, for example near the top of lower quench chamber 3 and/or the bottom of upper chamber 4. By this means, a supplemental amount of cooled clean recycle quench gas may be introduced into vessel 1. The spiral direction of the stream of recycle gas helps to direct all of the gases in the vessel upwardly. It also maintains a cool gas stream along the wall of vessel which protects the refractory. Advantageously, when tangential quench gas inlets 33 are employed, the face of cyclone inlet(s) 18 may be oriented to continue the direction of swirl.

The cooled clean recycle gas stream that is introduced into inlet 15 and optionally into tangential inlets 33 comprises at least a portion of the cooled clean gas stream from top outlet 9, after compression and with or without additional cooling or cleaning, or both downstream from vessel 1.

Other modifications and variations of the invention as hereinbefore set forth may be made without departing from the spirit and scope thereof, and therefore only such limitations should be imposed on the invention as are indicated in the appended claims.

We claim:

1. A process for quench cooling a hot gas stream comprising $H_2$, CO, $CO_2$, $H_2O$, and containing entrained solid matter and slag as produced by the partial oxidation of solid carbonaceous fuel and for separating therefrom at least a portion of said solid matter and slag comprising:

(1) passing said hot gas stream through a first gas inlet means into a lower chamber of a closed vertical cylindrical thermally insulated pressure vessel comprising said lower chamber which is coaxial with the central vertical axis of said pressure vessel and in communication with a coaxial upper chamber, said lower and upper chambers being connected by a coaxial choke-ring passage;

(2) simultaneously passing an oppositely directed stream of cooled and cleaned recycle quench gas through a second gas inlet means which is coaxial with said first gas inlet means and into said lower chamber producing a turbulent mixture of gases when said streams impinge, wherein molten slag entrained in said hot gas stream cools below the initial deformation temperature, settles out by gravity, and falls to the bottom of said lower chamber;

(3) passing the mixture of gases from the lower chamber upwardly through said choke-ring into said upper chamber in counter-flow with slag droplets;

(4) separating solid matter from said gas mixture in said upper chamber and removing said solid matter from said vessel by way of an outlet in the bottom of said lower chamber;

(5) removing cooled and cleaned gas from said upper chamber and discharging said gas through an outlet at the top of said vertical vessel; and (6) introducing a portion of said cooled and cleaned gas stream from (5) with further cooling and with or without further cleaning downstream into the lower chamber in (2) as at least a portion of said recycle gas.

2. The process of claim 1 with the added step of removing a portion of the slag from the hot raw gas stream before said gas stream is passed through said first inlet means in (1).

3. The process of claim 1 wherein said hot gas stream in (1) and said cooled and cleaned recycle quench gas stream in (2) are introduced into said lower chamber by way of a plurality of pairs of first and second coaxial opposed inlet nozzles.

4. The process of claim 1 wherein the longitudinal axis of said first and second coaxial opposed inlet means is in the same plane as the central vertical axis of the vessel and said longitudinal axis makes an angle in the range of about 30° to 150° with and measured clockwise from said central vertical axis.

5. The process of claim 1 with the additional step of introducing a portion of the cooled and cleaned gas stream from (5) into the top of the lower chamber and/or the bottom of the upper chamber by way of tangential inlet means.

6. The process of claim 1 with the added step of compressing said clean recycle gas stream to a pressure greater than that in the lower chamber prior to introducing same into the lower chamber in (2).

7. The process of claim 1 with the added step of introducing a portion of the cooled and cleaned gas stream from (5) into a gas cooler in indirect heat exchange with $H_2O$ and producing steam.

8. The process of claim 1 wherein a solids separation zone is provided in (3) selected from the group consisting of single and multi-stage cyclones, gas impingement separator, filter, and combinations thereof.

9. The process of claim 1 provided with the step of removing additional solids from the cooled and cleaned gas stream from (5) in a solids separation zone located downstream from said pressure vessel and selected from the group consisting of single and multi-stage cyclones, impingement separators, filters, electrostatic separators, and combinations thereof.

10. The process of claim 1 wherein said solid carbonaceous fuel is selected from the group consisting of particulate carbon, coal, coke from coal, lignite, petroleum coke, oil shale, tar sands, asphalt, pitch, and mixtures thereof.

11. The process of claim 1 wherein said solid carbonaceous fuel is subjected to partial oxidation either alone or in the presence of substantially thermally liquefiable or vaporizable hydrocarbon or carbonaceous materials and/or water.

12. The process of claim 1 wherein said solid carbonaceous fuel is introduced into the gas generator entrained in a gaseous medium selected from the group consisting of steam, $CO_2$, $N_2$, synthesis gas, and air.

13. The process of claim 1 with the step of passing a portion of the cooled and cleaned gas stream from (5) through an expansion turbine for the production of mechanical energy, electrical energy, or both.

14. The process of claim 1 wherein the hot gas stream in (1) is passed through the first gas inlet means at a temperature in the range of about 1700° to 3100° F., a pressure in the range of about 10 to 200 atmospheres, and a velocity in the range of about 10 to 100 feet per second; the recycle quench gas stream passing through the second gas inlet means in (2) comprises about 20 to 80 mol % of the gas from (5) at a temperature in the range of about 200° to 800° F. and has about the same momentum as the hot gas stream simultaneously passing through the first gas inlet means; and the cooled and cleaned gas in (5) is discharged at a temperature of about 1200° to 1800° F.

15. The process of claim 5 wherein said portion of cooled and cleaned gas stream that is introduced into said lower and/or upper chambers by way of said tangential inlet means comprises about 1 to 50 volume % of the recycle quench gas stream.

* * * * *